US006343803B1

(12) United States Patent
Johnston

(10) Patent No.: US 6,343,803 B1
(45) Date of Patent: Feb. 5, 2002

(54) SKATEBOARD AND RELATED APPARATUS

(76) Inventor: James K. Johnston, 808 Cerise Ave., Torrance, CA (US) 90503

( * ) Notice: Subject to any disclaimer, the term of this patent is extended or adjusted under 35 U.S.C. 154(b) by 0 days.

(21) Appl. No.: 09/649,353

(22) Filed: Aug. 28, 2000

(51) Int. Cl.[7] ..... B62M 1/00

(52) U.S. Cl. ..... 280/87.042; 280/11.27; 301/5.3

(58) Field of Search ..... 280/87.042, 87.041, 280/11.227, 11.27, 11.19, 87.01, 11.226, 11.28; 301/5.3, 5.7

(56) References Cited

U.S. PATENT DOCUMENTS 3,355,185 A * 11/1967 Carter ..... 280/11.19
3,362,722 A * 1/1968 Core ..... 280/87.042
3,795,409 A * 3/1974 Cudmore ..... 280/87.042
3,995,873 A * 12/1976 Pantzar ..... 280/11.28
4,047,727 A * 9/1977 Holloday et al. ..... 280/87.042
4,090,283 A * 5/1978 Woolley ..... 301/5.3 X
4,138,127 A * 2/1979 Kimmell et al. ..... 280/11.28 X
4,515,379 A * 5/1985 Pasques ..... 280/87.041 X
4,844,492 A * 7/1989 Ludwig ..... 280/11.28 X
5,549,331 A * 8/1996 Yun et al. ..... 280/87.042 X
5,803,473 A * 9/1998 Bouden ..... 280/87.042
6,019,382 A * 2/2000 Bouden ..... 280/87.042

FOREIGN PATENT DOCUMENTS

WO 95/27541 * 10/1995

* cited by examiner

*Primary Examiner*—Brian L. Johnson
*Assistant Examiner*—Bryan Fischmann
(74) *Attorney, Agent, or Firm*—Terrell P. Lewis

(57) ABSTRACT

A skateboard having a board on which a skateboarder stands or sits and a pair of truck assemblies, each truck assembly including a base member for attachment to one side of the board, a roller bracket for supporting a roller on the base member, and apparatus for pivotably coupling the roller bracket to the base member, including apparatus for normally urging the bracket to a centered position relative to the coupling apparatus. The base member further includes a pair of projections arranged parallel to one another and spaced apart a distance which is sufficient to accept the thickness of the roller bracket. The roller bracket includes opposing arm portions and a connecting bight portion. The projections include apertures which are aligned with one another and with an aperture in the bight portion of the roller bracket, and fasteners are provided for securing together the roller bracket bight portion and the projections such that the bight portion is pivotally supported between the projections for pivoting motion about the fasteners.

10 Claims, 2 Drawing Sheets

FIG. 1
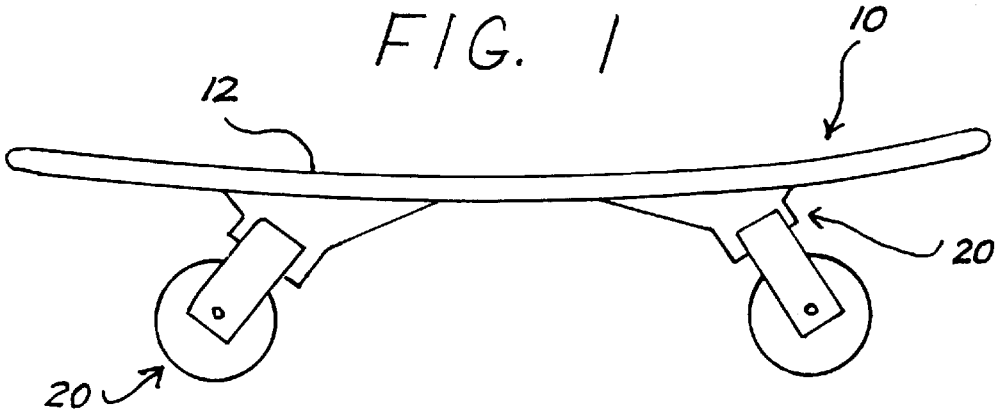
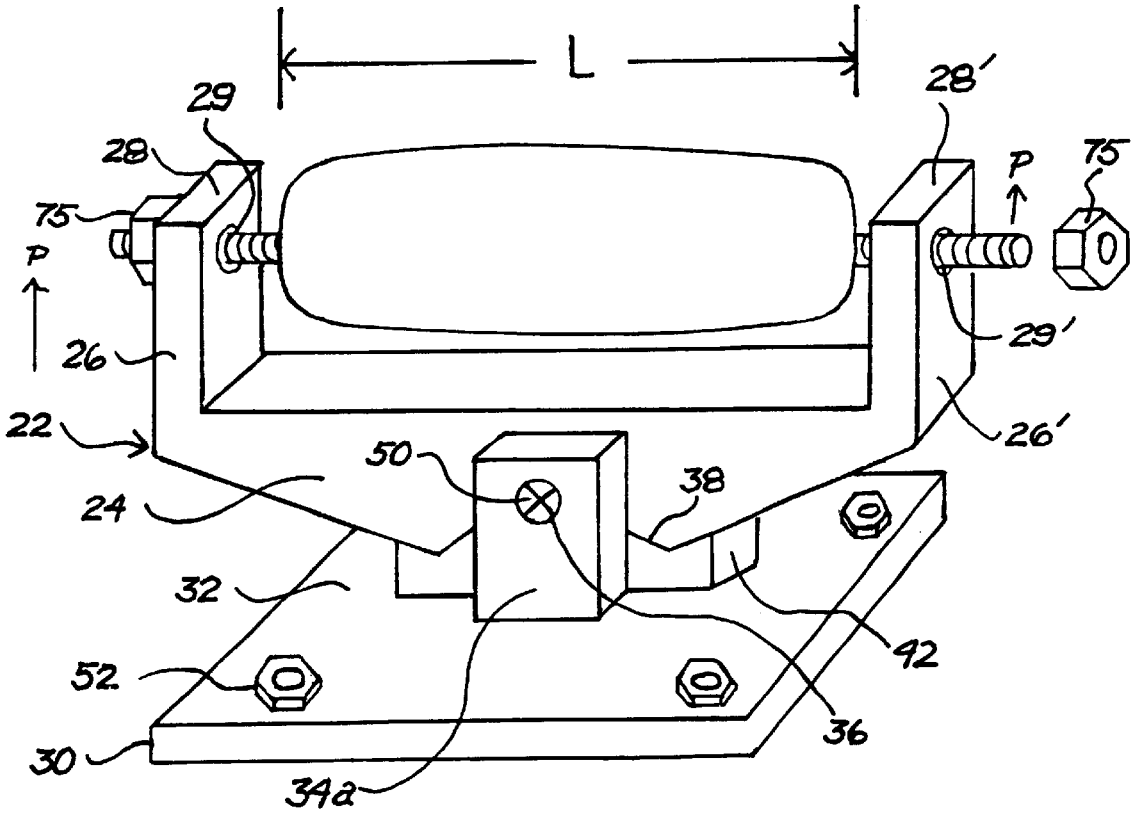
FIG. 2

SKATEBOARD AND RELATED APPARATUS

BACKGROUND OF THE INVENTION

1. Field of the Invention

The present invention relates to skateboards, and more particularly to a skateboard having a single pair of rollers attached to the underside of a support platform for supporting a human user standing on the platform, and a truck assembly having a novel roller and roller support structure.

2. Description of the Related Art

Wheeled personal recreational apparatus of the type used for exercise or pleasure have been known for years. Some of the more common contemporary devices are roller skates and roller skis, and skate boards. These devices typically consist of a support platform for supporting the user who stands or sits on the platform and a plurality of wheels or rollers, typically at least four, supported by the underside of the platform.

In recent years, improvements in such devices have been directed to a variety of aspects of construction as well as function. Some improvements relate to the boards themselves, as illustrated by U.S. Pat. No. 4,061,350 to Schmidt, Jr. et al which provides a modular wheel assembly construction that is designed for easier attachment to the underside of the skate board. Other improvements relate to the manner in which the wheels or rollers are supported to the board, as evidenced by U.S. Pat. No. 4,138,127 to Kimmell et al. which discloses a two wheel roller skate in which the two wheels rotate about parallel axes and are each supported in a cradle for rotation about an axis normal to the parallel axes. Other teachings relate to suspension arrangements associated with wheels or rollers for the skating devices, as for example the structure shown in U.S. Pat. No. 4,202,558 to Olschewski et al in which there is shown an elastic support member for rollers of skating devices wherein each support member includes a pin element extending at an acute angle downwardly from the mounting plate in a bore in the support member in such a manner that one end of the pin engages against the shaft of the roller and retains it in the bore. U.S. Pat. No. 4,168,842 to Kimmell et al. discloses a truck configuration for skate boards. Still other improvements relate to the wheel structure, as evidenced by U.S. Pat. No. 4,034,995 to Forward et al. which shows a skate including a boot having forward and rearward hollow spheroidal rollers in lieu of wheels.

One of the more significant problem areas encountered in the design of skate boards and the like relates to steering, while maintaining stability of the board. Typically, a truck is used to support a wheel and axle assembly to enable such steering, with the steering being accomplished by the shifting of the weight of the rider to one side of the of the board or the other side . Each of the front and rear roller assemblies in conventional skate boards are mounted in mirror image relation to one another to permit the two pairs of wheels to turn simultaneously in opposite directions resulting in both pairs of wheels defining an arc of a curve.

Typically, trucks for wheels used with skates and skate boards comprise a solid central member having spindles on opposite sides of the solid member for support of the wheels. Some truck designs also have cushion members to absorb jolts or biasing members to urge the wheel supporting trucks back to a centered position relative to the support board.

U.S. Pat. No. 3,995,873 to Pantzer discloses a two roller skateboard having a flat board with a pair of steerable rollers disposed about an underside thereof. Each of the two rollers are of substantial width, on the order of about one half of the overall width of the skateboard. Each roller is rotatably supported to the underside of the board in a manner to permit swivelling about a journal axis. A cantilevered leaf spring cooperates with a pinion in the journal for the swivel axis to return to a neutral position. The wider pair of roller offers stability to the rider at slower speeds and when the board is at rest; however, the Pantzer skateboard is still unstable and susceptible to tilting over during use because, although being wider than most wheels found in conventional skate boards, the limited width of the rollers contributes to board imbalance.

U.S. Pat. No. 5,160,155 to Barachet discloses a skateboard having two wheels mounted to an underside thereof, in which the rear wheel is fixed relative to the support board. The skateboard of Barachet has the disadvantage that the rear wheel protrudes through the surface of the board thereby making foot placement of the user on the board quite difficult.

Against this background of known technology, the applicant has developed a novel wheel structure which can be used for skates, a skateboard, skis for use on a hard surface, a scooter, or any other related vehicular device. A preferred embodiment includes a board on which a user stands, and a pair of wheel members arranged parallel to one another and attached to the underside of the board. Preferably, the wheel members comprise a roller, each of which is mounted on a bracket pivotally secured to a clevis attached to the underside of the board. The roller bracket includes resilient means for absorbing shocks during use and for biasing the roller bracket into a centered position on the clevis. Preferably, the rollers are elongated along the axis of rotation of the rollers, and the exterior surface of the rollers is tapered at each end of the roller to enhance steering and control of the board.

OBJECTS AND SUMMARY OF THE INVENTION

It is therefore an object of the present invention to provide a novel construction for a personal recreational device of the type on which a user stands and which is outfitted with rollers pivotably supported relative to the device that permit rolling motion of the device which is controlled by the user, and which will overcome many of the disadvantages and drawbacks of similar devices known in the art.

Another object of the present invention is to provide a novel skate board design which includes forward and rearward rollers attached to the underside of a board, where the rollers have an elongated barrel shape with tapered ends which facilitate steering and control of motion of the board.

Still another object of the invention is to provide a set of rollers, each of which includes a roller element having a central portion and end portions, the roller being of elongated configuration along the axis of rotation.

Still another object of the invention is to provide a skateboard which uses a compressive pad of resilient, rubber-like material which can be subjected to compressive stresses by a roller-carrying bracket during turning such that the compressive pad will restore the bracket to its normally-centered position after completion of the turn, thereby assuring optimum simplicity in the turning or steering of the skateboard.

Still another object of the invention is to provide a kit for converting a conventional skate board to the board of the present invention, the kit including a set of trucks each having a base portion, elastic cushion means on the base portion, a bracket, and a roller mounted by the bracket to the truck.

Other objects, advantages and features of the invention will become more apparent, as will equivalent structures which are intended to be covered herein, with the teaching of the principles of the invention in connection with the disclosure of the preferred embodiments thereof in the specification, claims and drawings in which:

BRIEF DESCRIPTION OF THE DRAWINGS

FIG. 1 is a side view of the skate board 10 according to the present invention;

FIG. 2 is a perspective view of a truck assembly 20 according to the present invention.

DETAILED DESCRIPTION OF THE INVENTION

Figure 3:
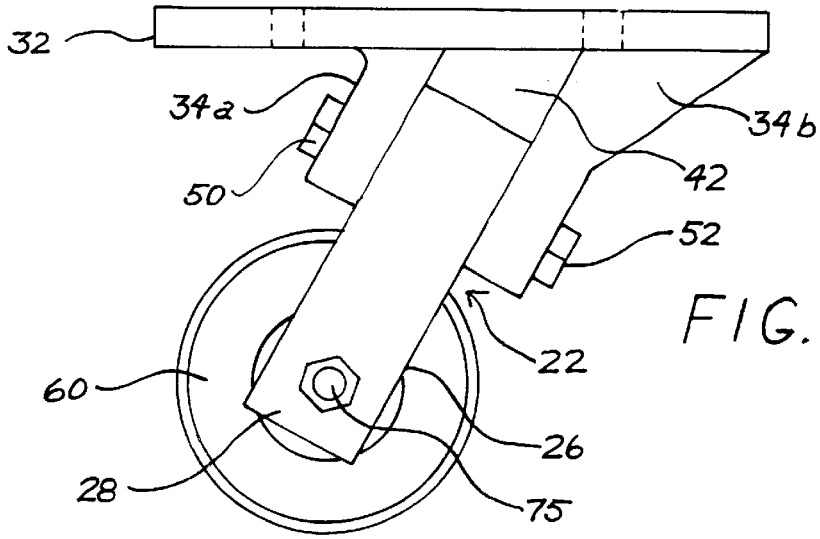
FIG. 3 is a side view of the truck assembly 20 shown in FIG. 2.

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide a novel personal recreational device, such as a skate or skateboard, that encompasses many long sought after features not found in relevant prior devices.

Referring now to FIG. 1, there is shown a skateboard 10 which comprises a board or platform 12 and a pair of truck assemblies 20 supported and secured to the underside of the board 12. It is contemplated that the board 12 as used in accordance with the teachings of the present invention is a conventional board found in a variety of sports shops.

The truck assemblies are designed to be secured to the underside of the board via screws or bolts (see 52 in FIG. 2) that are provided with such conventional boards.

Referring now specifically to FIGS. 2 and 3, each truck assembly is seen to include a base member 30 having through holes (not shown) for receipt of threaded fasteners 52, as for example bolts or screws, in order to secure the base portion of the truck assembly to the underside of the skateboard. Generally, a conventional skateboard 12 is provided with pre-drilled openings (most often on the underside thereof) which are typically threaded. These openings receive the threaded fasteners 52 for enabling secure attachment of the truck assembly to the platform of the skateboard.

The base member 30 of the truck assembly comprises a substantially planar plate portion 32 and includes a pair of ears 34*a*, 34*b* which are disposed parallel to one another and spaced apart by an amount sufficient to receive therebetween the thickness of the bight portion 24 of the roller bracket 22 and a resilient biasing member or cushion 42. The resilient member or cushion 42 is preferably made of a compressible material such as rubber, neoprene, a soft plastic or similar material, and is arranged between the ears 34*a*, 34*b* as well as between the roller bracket bight portion 24 and the surface of the base member adjacent to the bight portion of the roller bracket 22. A bolt 50 having a threaded shank defining a longitudinal axis is provided for passage through aligned openings 36 (only one opening is shown in ear 34*a*, but it is to be understood that an opening of similar size is also provided in ear 34*b*) and an opening in the bight portion 24 of the roller bracket 22 to pivotably secure the roller bracket 24 to the ears 34*a*, 34*b*. The externally threaded bolt 50 is secured in place by an internally threaded nut 52 positioned adjacent to the ear 34*b*. The nut, when tightened, presses against the outer surface of the ear 34*b*, as shown in FIG. 3, thereby drawing the ears together and firmly holding the roller bracket therebetween. Although the bracket is secured to the ears 34*a*, 34*b*, it is nevertheless free to pivot laterally from side to side about the longitudinal axis of the bolt 50, the latter due to the fact that the diameter of the openings 36 in the ears is greater than the diameter of the threaded bolt 50. The resilient biasing member or cushion 42 is disposed between the planar plate portion 32 of the truck assembly and the bight portion 24 of the bracket, and provides a biasing force on the bracket when the bracket is pivotally displaced about the bolt 50 from the substantially centered position depicted in FIG. 2 relative to the truck assembly base member (the reasons for which will become clearer when discussed below.

Figure 4:
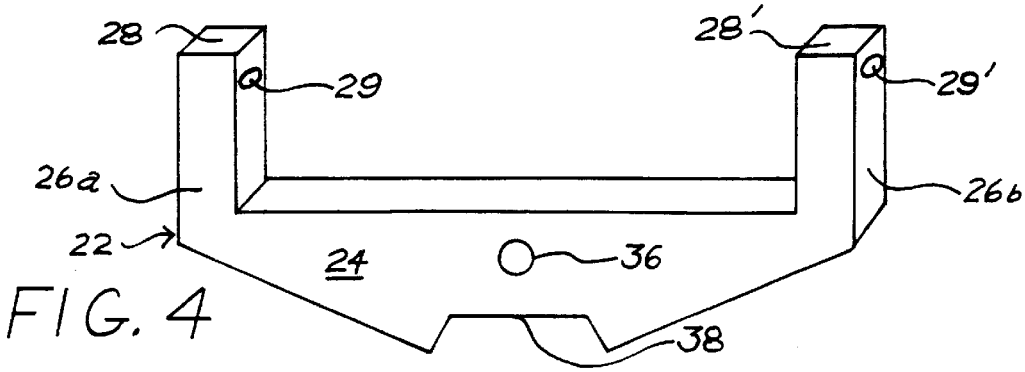
FIG. 4 is a plan view of the roller bracket 24 shown in FIG. 3.

The roller bracket 22 (see FIG. 2, 3 and 4) comprises a U-shaped structure having two substantially parallel arms 26*a*, 26*b* extending in a first direction P from one side of the bight portion 24. A throughhole 25 is formed in the bight portion 24 and is positioned to be in alignment with the openings 36 in the ears 34*a*, 34*b* when the roller bracket is mounted to ears 34*a*, 34*b* of the base member 30. The terminal region 28 of each arm includes an opening 29, 29'.

The longitudinal axes of openings 29, 29' are substantially coincident and arranged substantially normal to the first direction P as well as the longitudinal axis of bolt 50. Preferably, the through hole 25, and the through openings 29, 29', are provided with bushings that line the interior surfaces thereof. The portion of the bight portion 24 opposite the arms includes a cutout region 38 for engagement with the resilient member 42. As noted above, the bracket bight portion, while being able to rock about the "pivot" formed by the bolt 50, is also biased into a centered position relative to the "pivot" such that the outer extents of the bight portion (i.e., the region where the arms 26*a*, 26*b* merge with the bight portion 24) are equally spaced from the base member.

Figure 5:
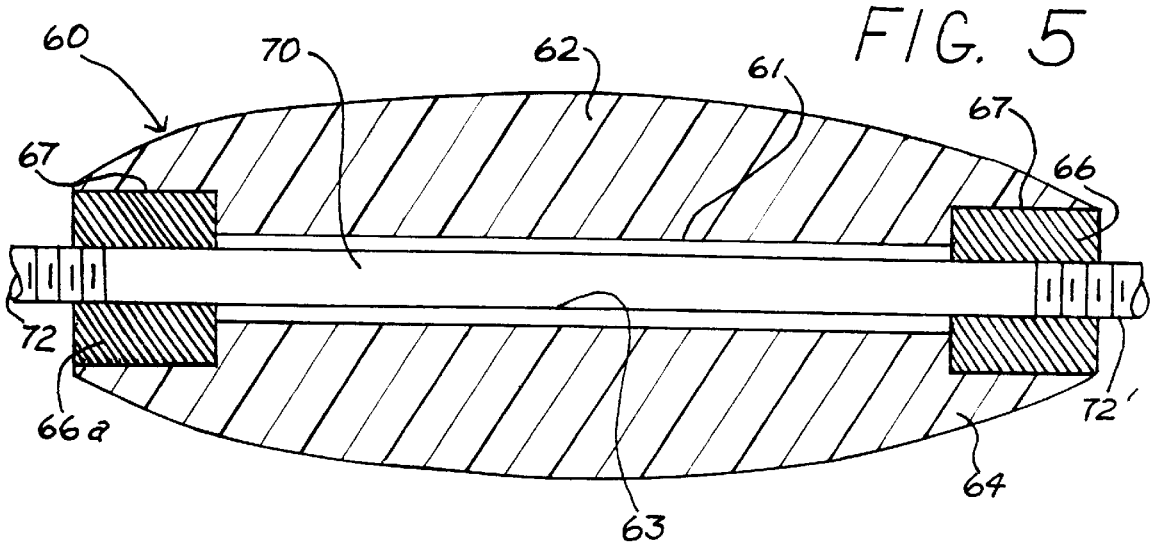
FIG. 5 is a sectional view of the roller 60 shown in FIG. 2.

The arms 26*a*, 26*b* of the roller bracket 22 support the roller 60 (see FIG. 2). The roller 60 is an elongated substantially cylindrical member having a longitudinal length L corresponding to the distance between the facing surfaces of the arms 26,26' of the roller bracket 22. The roller 60, which has a central longitudinal bore 61 therein, is preferably made of a material which is durable and exhibits low frictional characteristics, as for example, teflon, nylon, Delrin or urethane. As seen in FIGS. 2 and 5, the roller has a substantially cylindrical central portion 62 having an outer surface of a first diameter, and end portions 64 which are tapered so that the diameter of the outer surface of the roller 60 at the tapered end portions 64 is smaller than at the diameter of the outer surface of the central portion 62. The tapered outer portions of the roller 60 facilitate steering and control of the skateboard during its use.

Bearing assemblies 66*a*, 66*b* are mounted at respective ends of the roller bore 67. A hollow metal bushing 63 is mounted in the axial bore 61 of the roller 60. Preferably, the bushing is made of a tough material, such as plastic or metal. The longitudinally inner ends of the bearing assemblies are seated against the longitudinally outer ends of the bushing. The diameter of the bushing bore is approximately the same as the diameter of the bores of the bearing assemblies. A rod 70 is axially disposed within the roller 60 and extends within the bores of the bearing assemblies and the bushing. Ends 72,72' of the rod are externally threaded and protrude axially away from opposite ends of the roller. In assembling the roller 60 to the roller bracket 22, the roller is first positioned between the roller bracket arms 26*a*, 26*b* and then the rod 70 is inserted through one of the openings in a first of the bracket arms and pushed through the roller inside the bushing until it extends from the opposite side of the roller and through the other of the openings in the second of the bracket arms. Nuts 75 are secured to the threaded ends of the rod on the outside of the bracket arms. Tightening the nuts on the threaded ends of the rod 70 squeezes the arms together and into compressive engagement with the bearing assemblies 66*a*, 66*b*, which in turn press the bearing assemblies longitudinally inward and into compressive engagement with the bushing. In this way, the inner races of the bearing assemblies are locked together with the bushing 63 and the bracket arms 26*a*, 26*b* and prevented from rotating relative to the roller, while the outer races of the bearing assemblies, on which the roller body is mounted, are free to rotate about the longitudinal axis.

The purpose of the pivoted connection between the bracket 22 and the base member 30 as well as the compressible cushion 42 and the novel roller 60 is to facilitate steering and/or control of the skateboard when in motion.

As was briefly mentioned above in connection with the discussion of relevant known devices, steering of skateboards in general, and of the skateboard of the present invention requires, as known from the prior developed skateboards, a shift of the weight of the user to the side of the board to which the user wishes to steer.

The skateboard of the present invention provides superior stability, control and steering capabilities due to the novel configuration of roller 60 and the connection between the bracket for the roller and the compressible cushion 42. When a user desires to effect a turning maneuver, he or she typically shifts his feet from a position which is more or less centered relative to the upper surface of the support board to a position where his or her feet are closer to that side of the support board to which a turn is to be made. Steering is accomplished by the user's shifting his or her weight relative to the center of gravity of the skateboard, or by moving his or her feet from a central region of the skateboard to a lateral region of the board. Such shifting or moving of the feet on the board causes the bracket 22 to pivot about the bolt 50, and the weight of the user and the board to shift from the central region 62 of the roller toward one of the end portions 64 of the roller 60. The roller bracket 22 pivots relative to the truck base member 30 about the bolt 50, and after the turn has been made, when the user shifts his or her weight toward the central portion of the support board, the resilient biasing member 42 urges the roller bracket 22 back toward the centered position seen in FIG. 2.

That this action takes place without severe tipping or overturning of the board of the present invention is a testament to the novel configuration of the roller 60. In similar prior devices, as exemplified by U.S. Pat. No. 3,995,875 to Pantzar (discussed above), the width of the roller is approximately no more than one half of the width of the skateboard. The flat uniform surface of the Pantzar roller coupled with the limited length reduces the turning capability and stability of the board insofar as when the user shifts his/her weight to one side of the board to effect a turning/steering action, one side of the roller is caused to lift off the ground followed by a tipping action of the board to such an extent that the edge of the board opposite the side of the roller that has been raised off the ground moves toward or into contact with the ground, thereby placing the user of the board in jeopardy of serious injury. Instability of the Pantzar board is amplified when the user attempts to make a tight turn or when the user possesses great weight.

In contrast, the roller configuration of the present invention will easily accommodate overweight users while permitting, for any user, tilting of the board (and roller) in such a manner as to effect tight turns while maintaining substantial stability. Preferably, the width of the roller of the present invention is very nearly 75% of the width of the skateboard, if not wider. The added width, and the sloped shoulders, of the roller configuration disclosed herein permits tilting of the board while maintaining a substantial portion of the surface of the roller in contact with the ground during nearly all steering maneuvers. Moreover, the roller bracket 22 allows the board to rest on it when the board is tipped to its maximum angle of tipping. The design of the roller of the present invention, along with the roller supporting structure, provides optimum assurance that, when the user effects an extreme turning maneuver, no edge of the board will be able to make contact with the ground, and the board will not overturn and will remain stable.

The present invention also embraces providing, in appropriate packaging (not shown), a kit comprising one, or two, of the truck assemblies for the purpose of converting a conventional skateboard to a board of the type described herein in accordance with the teachings of this invention. It is also contemplated that a user could repair or replace one or both of the trucks attached to the skateboard of the present invention as described herein.

Those skilled in the art will appreciate that various adoptions and modifications of the invention as described above can be configured without departing from the scope and spirit of the invention. Therefore, it is to be understood that, within the scope of the appended claims, the invention may be practiced other than as specifically described herein.

What is claimed is:

1. A skateboard, comprising:

a board on which a skateboarder stands or sits, and a pair of truck assemblies, each truck assembly including a base member for attachment to one side of the board, a roller, a roller bracket for supporting said roller on the base member, and a pair of projections depending from said base member for pivotably coupling said roller bracket to said base member, said projections being arranged parallel to one another, said roller having a width substantially greater than one half the width of the board for imparting enhanced stability to the board during turning maneuvers, and a compressible biasing member disposed between, and engaging, said base member, said projections and said bracket.

2. The skateboard of claim 1, wherein said roller bracket is a "U"-shaped element which includes opposing arms and a bight portion connecting said arms, and said projections are each provided with an aperture, the apertures being aligned with one another and with an aperture in the bight portion of the roller bracket, and fastener means for securing together the roller bracket bight portion and the projections such that the bight portion is pivotally supported between the projections for pivoting motion about the fastener means.

3. The apparatus of claim 1, wherein the roller has a central portion and end portions unitary with the central portion, the diameter of said end portions being less than the diameter of said central portion, and wherein the outer surface of said end portions are tapered.

4. The skateboard of claim 1, wherein the width of the roller is at least 75% of the width of the skateboard.

5. A skateboard, comprising:

a support platform for supporting a human user thereon, said platform including a pair of base members attached thereto, each having parallel extensions depending therefrom bearing pivot means, a pair of U-shaped brackets, each of said brackets mounted to a respective base member and comprising a bight portion adapted for pivoting attachment to the extensions of the base member of the support platform, and parallel arm portions depending from opposing ends of said bight portion, a compressible resilient member confined between and engaging the surface of said bight portion adjacent to said base member, said parallel arm portions, and said base member, and a single pair of rollers, each roller being attached to a respective one of the brackets at the underside of said support platform, said rollers being spaced apart and arranged in proximity to a respective end region of said platform, each of sail rollers being secured to said bracket between said arms and having a length substantially as great as the width of the board.

6. The skateboard of claim 5, wherein said compressible resilient member comprises a block of material that exhibits elastic properties.

7. The skateboard of claim 5, wherein said roller is an elongated cylinder having a body portion and end portions unitary therewith, said end portions being of smaller diameter than the diameter of the body portion.

8. A skate board, comprising:

a board having an upper surface on which a skateboarder stands or sits, a pair of base members attached to the lower surface of the skateboard, each base member defining a plate element having one major surface attached to the lower surface of the skateboard and an opposing major surface parallel with the one major surface, each of said base members being attached to an end region on the lower surface of the skateboard, a U-shaped bracket pivotally attached to each of the base members and depending therefrom toward a support surface on which the skateboard rides, each of said brackets comprising a first elongated bight having a portion adapted for connection to the base member and a pair of arms extending away from the bight in the same direction, said arms being parallel to one another and being adapted to support a roller element therebetween, a roller element supported by each said U-shaped bracket between the arms thereof, said roller element being of cylindrical configuration and having a first centrally located portion of a first diameter and second portions disposed laterally of the first portion, the diameter of said second portions being smaller than the diameter of said first portion, and said first and second portions being unitary, and a compressible block of resilient material carried by each said bracket, said compressible block being disposed between and engaging said base member and a surface of said bight facing said base member.

9. The skateboard of claim 8, wherein each of the base members includes a pair of parallel projections extending away from the opposing major surface of the base member, and each said projection has an opening in a free end region thereof, the bight of each bracket includes an opening in a central portion thereof, and a fastener extending through the openings of the parallel projections and the opening in the bight of each of said brackets, wherein said compressible member is contained between said fastener, said parallel projections and the bight of said bracket.

10. A truck for a skate or skateboard, comprising:

a base member adapted for attachment to a support, said base member including a pair of parallel, spaced apart, projections depending therefrom, a U-shaped bracket including a central portion pivotally secured to, and between, said projections depending from said base member, a resilient member positioned between and engaging the base member, the projections, and the central portion of said bracket for biasing said bracket toward a centered position relative to said base member, and a roller carried by said bracket, said roller comprising a central ground-engaging portion and lateral shoulder portions of reduced diameter, said lateral shoulder portions being unitary with said central ground-engaging portion.

* * * * *